US005600992A

United States Patent [19]

Kanazawa et al.

[11] Patent Number: 5,600,992

[45] Date of Patent: Feb. 11, 1997

[54] DIE SET

[75] Inventors: Yoshitomo Kanazawa; Toshiyuki Nanaarashi; Toshiki Miyazawa, all of Tokyo, Japan

[73] Assignee: Hidaka Seiki Kabushiki Kaisha, Tokyo, Japan

[21] Appl. No.: 371,120

[22] Filed: Jan. 11, 1995

[30] Foreign Application Priority Data

Feb. 10, 1994 [JP] Japan ..... 6-016042

[51] Int. Cl.[6] ..... B21D 22/00

[52] U.S. Cl. ..... 72/352; 72/353.2; 72/355.4; 72/356

[58] Field of Search ..... 72/352, 328, 327, 72/335, 356, 355.4, 355.6, 465, 355.2, 353.2, 334, 333

[56] References Cited

U.S. PATENT DOCUMENTS

| | | | |
|---|---|---|---|
| 3,124,876 | 3/1964 | Putetti | 72/356 |
| 4,055,067 | 10/1977 | Kozima . | |
| 4,667,394 | 5/1987 | Bode et al. | 72/355.4 |
| 4,667,499 | 5/1987 | Bull | 72/352 |
| 4,956,989 | 9/1990 | Nakajima | 72/327 |
| 5,115,663 | 5/1992 | Ando et al. | 72/356 |

FOREIGN PATENT DOCUMENTS 5-200450 8/1993 Japan .

*Primary Examiner*—Daniel C. Crane
*Assistant Examiner*—Rodney Butler
*Attorney, Agent, or Firm*—Birch, Stewart, Kolasch & Birch, LLP

[57] ABSTRACT

An object of the present invention is to provide a die set, which is capable of removing the influence of heat expansion and the change of the number of the collared holes and improving the accuracy of the collar height. In a die set including an upper die and a lower die wherein a metal plate having a collared hole is provided between the dies to form a flange section at an end of the collar, a flare-punch is provided to the upper die and is capable of vertically moving therein. The flare-punch has a flange forming section for forming the flange section. A biasing member biases the flare-punch toward the lower die. A level pin for defining a lower dead point of the flare-pin is provided to the lower die. The level pin is capable of coming into contact with the flare-punch, which has been in the collar, when the upper die and the lower die are closed.

17 Claims, 6 Drawing Sheets

DIE SET

BACKGROUND OF THE INVENTION

The present invention relates to a die set, more precisely it relates to a die set comprising: an upper die; and a lower die being capable of relatively moving to and away from the upper die, wherein a metal plate having a through-hole, which is rounded by a collar with prescribed height, is provided between the upper die and the lower die, and a flange section is formed at an end of the collar by the dies.

A radiating fin, which is employed to heat exchangers for air conditioners, has a metal plate section, which is made of, for example, a rectangular thin aluminum plate, and a multiple collared holes, which are bored in the metal plate section.

In the heat exchanger, a plurality of said fins are stacked, and the collared holes of each fin are coaxially connected. Metal pipes, which are made of high heat conductive metal, e.g., copper, are pierced through the collared holes, which have been coaxially connected, so that the fins and the metal pipes can be integrally assembled. Thus, clearance between adjacent fins is almost equal to the height of the collars of the collared holes.

The fins of the heat exchanger are made by, for example, the method disclosed in U.S. Pat. No. 4,055,067. The method is shown in FIGS. 7A–7D.

In the method, firstly a thin metal plate 100 is bored and burred to form a hole 101 rounded by a projected section 102 (see FIG. 7A). Successively, the diameter of the hole 101 is enlarged and the projected section 102 is ironed to extend until the projected section is formed into a collar 104 with prescribed height (see FIGS. 7B and 7C).

Further, an upper end of the collar 104 is flared to form a flange section 105 (see FIG. 7D).

The above described fin may be manufactured by a die set shown in FIG. 8. The metal plate 100 is fed and intermittently conveyed in the direction of an arrow A. The metal plate 100 is conveyed into stages 14, 16, 18 and 200, which are set between a vertically movable upper die 10 and a fixed lower die 12, in order. Afterwards the metal plate 100 comes out in the direction of an arrow B.

The boring and the burring shown in FIG. 7A are executed in the stage 14; the ironing shown in FIGS. 7B and 7C are executed in the stages 16 and 18; and the flaring shown in FIG. 7D is executed in the stage 200.

In the die set having the stage 200, there is fixed a flare-punch 204 in an upper die 202 (see FIG. 9), so that an end part of the flare-punch 204 gets into the collar 104 of the metal plate 100, which has been mounted on a lower die 206, and forms the flange section 105 at the end of the collar 104.

The height of the collar 104 of the metal plate 100, which has passed the stage 200, is equal to distance H between the flange forming section 205 of the flare-punch 204 and an upper face of the stage 200 in the lower die 206, so that the collar height or the distance H is defined by the lowest position of the downward movement (the lower dead point) of the flare-punch 204.

Note that, the lower die 206 has a hole 208 into which the lower end part of the flare-punch 204, which has pierced through the collared hole 102, is able to get.

Conventionally, the lower dead point of the flare-punch 204 cannot be adjusted while manufacturing.

While a press machine with said die set is in operation, the die set is heated, so that the temperature of the die set rises until the heating calory and the radiating calory are balanced. By the heating, members constituting the press machine expand. With the result of the heat expansion, the lower dead point of the flare-punch 204 is changed with the lapse of time. Thus, the collar height H of starting the press machine is different from that of stopping the machine.

If multiple fins whose collar height H is not fixed, as described above, are stacked, the height of a radiating section of a heat exchanger is apt to be different in places.

The unstable manufacturing accuracy can be solved by a cooling system, which cools the press machine to maintain the temperature thereof by a fluid, e.g., oil, circulating in pipes.

However, the press machine with the cooling system must be complex in structure and large in size.

Before starting the press machine, the lower dead point of the flare-punch 204 may be adjusted to a proper position considering the heat expansion. But in this case, it is very difficult for unskilled persons to properly adjust the lower dead point. Furthermore, even if the lower dead point is properly adjusted, the lower dead point changes by the heat expansion, so that the manufacturing accuracy cannot be fixed.

Even if the die set is designed to simultaneously form, for example, three flange sections, there is a case that one or two flange sections are formed. In the case where the actual number of flange forming sections is less than the planned number thereof, unbalanced force acts on the upper die to which the flare-punches are provided, so that the upper die is slightly inclined. Even if the press machine has the cooling system, the inclination of the upper die which is caused by said unbalanced force cannot be avoided. By said inclination of the upper die, the height of the collars must be scattered in places.

To solve this problem, one of inventors of the present invention invented a die set disclosed in Japanese Patent Kokai Gazette 5-200450. The die set is shown in FIG. 10.

In the die set, there is provided a measuring sensor 226 in a lower die 206; there is provided an object member 225 in an upper die 202. When the distance between a lower face of the upper die 202 and an upper face of the lower die 206 is the shortest or when the upper die 202 reaches the lower dead point, a measuring section 224 measures the distance to the object member 225 by the sensor 226. An elevating section 210 is capable of vertically adjusting the lower die 206 so as to adjust the lower dead point of the upper die 202. A stepping motor 220 vertically moves the elevating section 210 on the basis of the distance measured by the measuring section 224.

Note that, the elevating section 210 has a plurality of fixed triangle members 212, which are fixed on the upper face of a lower base 12 and whose sloping faces are arranged on upper sides, and a plurality of movable triangle members 214, whose sloping faces are capable of respectively sliding on the sloping faces of the fixed triangle members 212.

In the die set shown in FIG. 10, if the lower dead point of the upper die 202, which has been measured by the measuring section 224, is changed or shifted with respect to an initial set position with the lapse of time, the lower die 206 is moved upward by the stepping motor 220. With this mechanism, the lower dead point of the upper die 202 can be maintained at the initial set position as much as possible, so that the collar height of the collared holes can be equal as much as possible.

However, in the die set shown in FIG. 10, the manufacturing accuracy is affected by errors in the measuring section 224, the stepping motor 220, the elevating section 210, etc., so that the scatter of the collar height cannot be fully removed. Furthermore, means for driving the elevating section 210, e.g., the stepping motor 220, and means for controlling must be provided in the die set, so the die set must be complex in structure and large in size.

SUMMARY OF THE INVENTION

An object of the present invention is to provide a die set, which is capable of removing the influence of the heat expansion and the change of the number of the collared holes and improving the accuracy of the collar height.

Another object is to provide a die set having a simple structure.

The present invention was invented according to the fact that the lower dead points of the flare-punches can be fixed as much as possible by biasing the flare-punches, which are provided to the upper die, downward and providing level pins for defining the lower dead points of the flare-punches in the lower die in spite of the heat expansion of the press machine.

Namely, in a die set comprising:

an upper die; and a lower die being capable of relatively moving to and away from the upper die, wherein a metal plate having a through-hole, which is rounded by a collar with prescribed height, is provided between the upper die and the lower die, and a flange section is formed at an end of the collar when the upper die and the lower die are closed, wherein the improvement as to the present invention, comprises:

a flare-punch being provided to the upper die and being capable of vertically moving therein, the flare-punch having a flange forming section for pressing the end of the collar to form the flange section, the flange forming section being provided in an end part of the flare-punch, which is capable of getting into the collar when the upper die and the lower die are closed;

a biasing member for biasing the flange forming section of the flare-punch toward the lower die with elastic force equal to or greater than the pressing force for forming the flange section; and a level pin for solely defining a lower dead point of the flare-punch without reference to the upper die being provided to the lower die, the level pin being capable of coming into contact with the end of the flare-punch, which has been in the collar, when the upper die and the lower die are closed.

In the present invention, the end of the flare-punch is moved downward together with the upper die until the end of the flare-punch contacts the level pin at the lower dead point when the upper die moves downward to close the dies, so that the end of the collar is bent and formed into the flange section by the flange forming section of the flare-punch.

When the flare-punch contacts the level pin and reaches the lower dead point and the upper die further moves downward, counter force against the force of the biasing member for biasing the flare-punch toward the lower die, which is equal to or greater than the pressing force for forming the flange section, acts on the flare-punch. Thus, in the die set of the present invention, the force acting on the flare-punch which is greater than the elastic force of the biasing member can be absorbed by the biasing member, so that the lower dead point of the flare-punch can be fixed.

By the fixed lower dead point, the die set of the present invention is capable of removing the influence of the heat expansion of the press machine and the change of the number of the collared holes and improving the accuracy of the collar height, so that the height of the radiating section of the heat exchanger can be same in places.

Further, no driving means such as the stepping motor is required in the die set, so the die set of the present invention can be simple in structure and smaller in size.

BRIEF DESCRIPTION OF THE DRAWINGS

Embodiments of the present invention will now be described by way of examples and with reference to the accompanying drawings, in which.

DETAINED DESCRIPTION OF THE PREFERRED EMBODIMENTS

Preferred embodiments of the present invention will now be described in detail with reference to the accompanying drawings.

Figure 1:
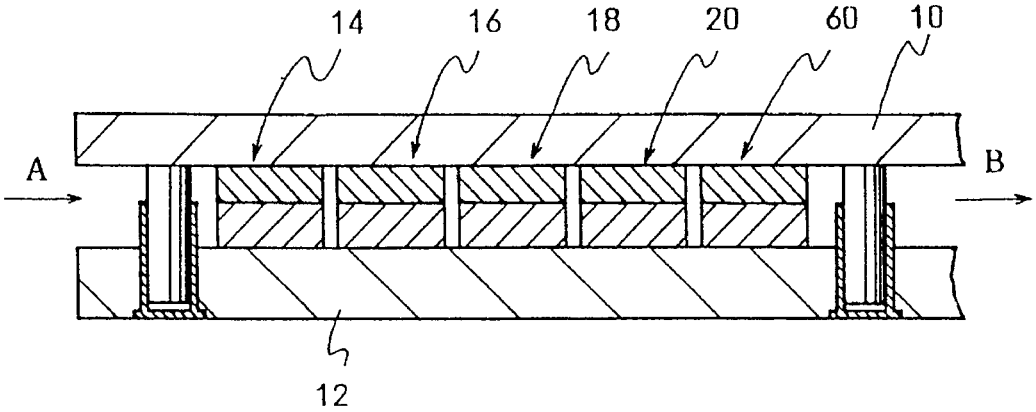
FIG. 1 is a partial sectional side view of an embodiment of the die set of the present invention.

FIG. 1 is a partial sectional side view of this embodiment.

In FIG. 1, a metal thin plate (not shown) is fed between an upper base 10, which is capable of vertically moving, and a lower base 12, which is fixed, in the direction of an arrow A. The metal plate is intermittently sent in the direction A to pass stages 14, 16, 18, 20 and 60, which are provided between the upper base 10 and the lower base 12, in order, and finally discharged in the direction of an arrow B.

Figure 7A:
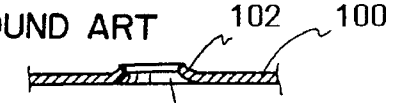
FIG. 7A BACKGROUND ART
FIGS. 7A through 7D show explanation views showing the steps of manufacturing the fins of the heat exchanger.
Figure 7B:
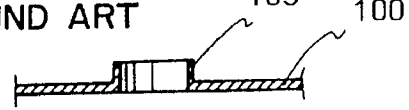
FIG. 7B BACKGROUND ART
Figure 7C:
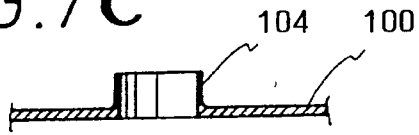
BACKGROUND ART FIG. 7C
Figure 7D:
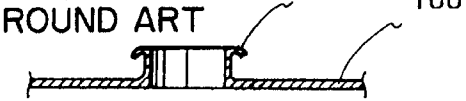
FIG. 7D BACKGROUND ART
Figure 8:
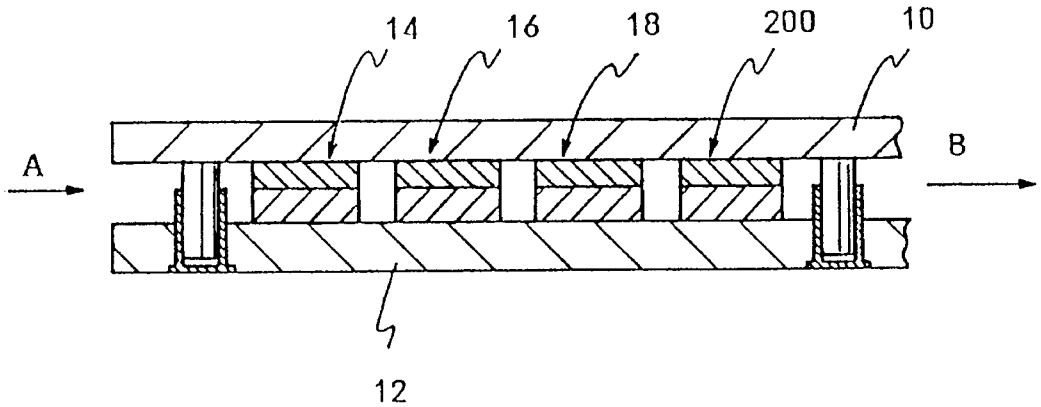
FIG. 8 BACKGROUND ART
FIG. 8 is a partial sectional side view of the conventional die set for manufacturing the fins shown in FIG. 7.
Figure 9:
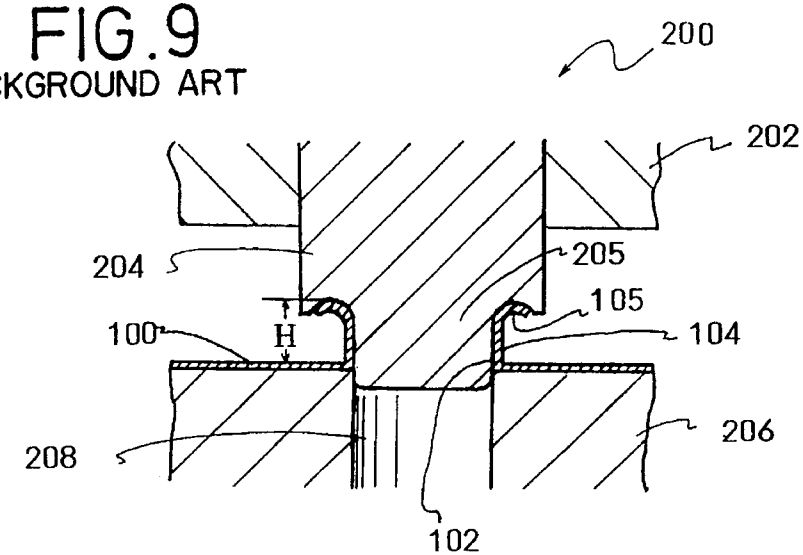
FIG. 9 BACKGROUND ART
FIG. 9 is a partial sectional view showing the flaring step in the flaring stage of the die set shown in FIG. 8.
Figure 10:
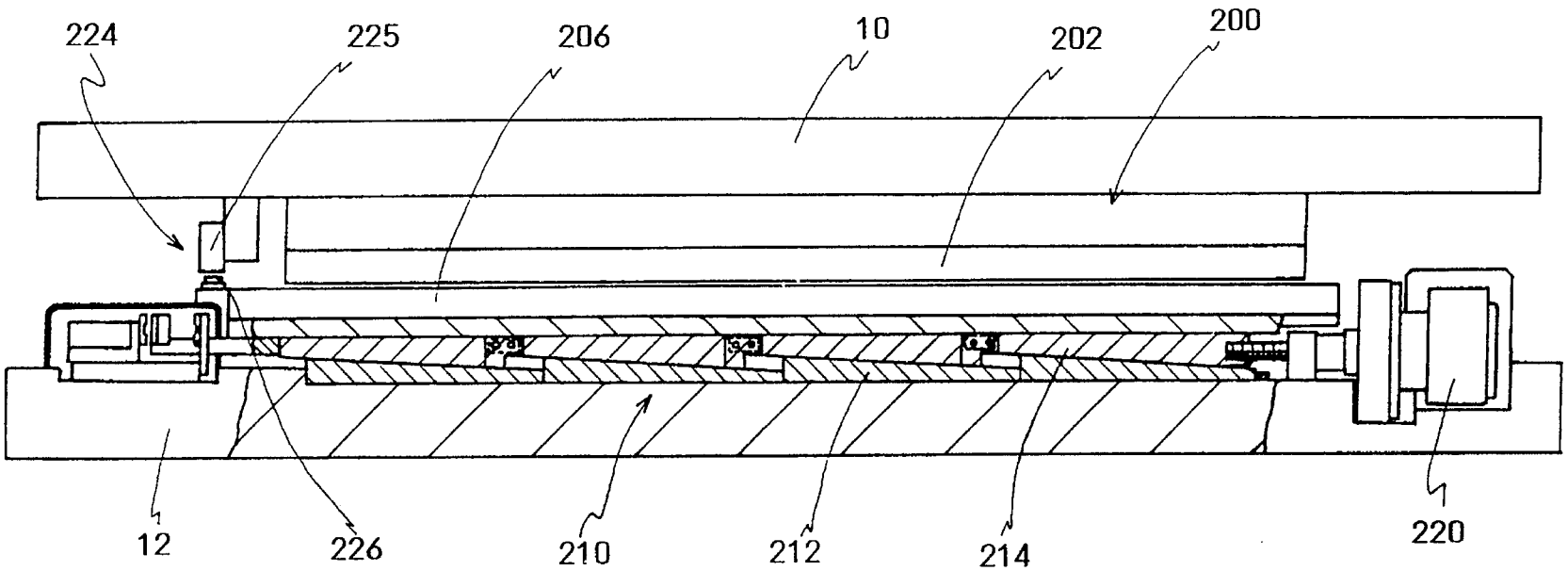
FIG. 10 BACKGROUND ART
FIG. 10 is a sectional view showing the conventional die set having the means for fixing the lower dead point of the upper die.

The boring and the burring steps (see FIG. 7A) are executed in the stage 14; the ironing steps (see FIGS. 7B and 7C) are executed in the stages 16 and 18; and the flaring step is executed in the stage 20.

Figure 2:
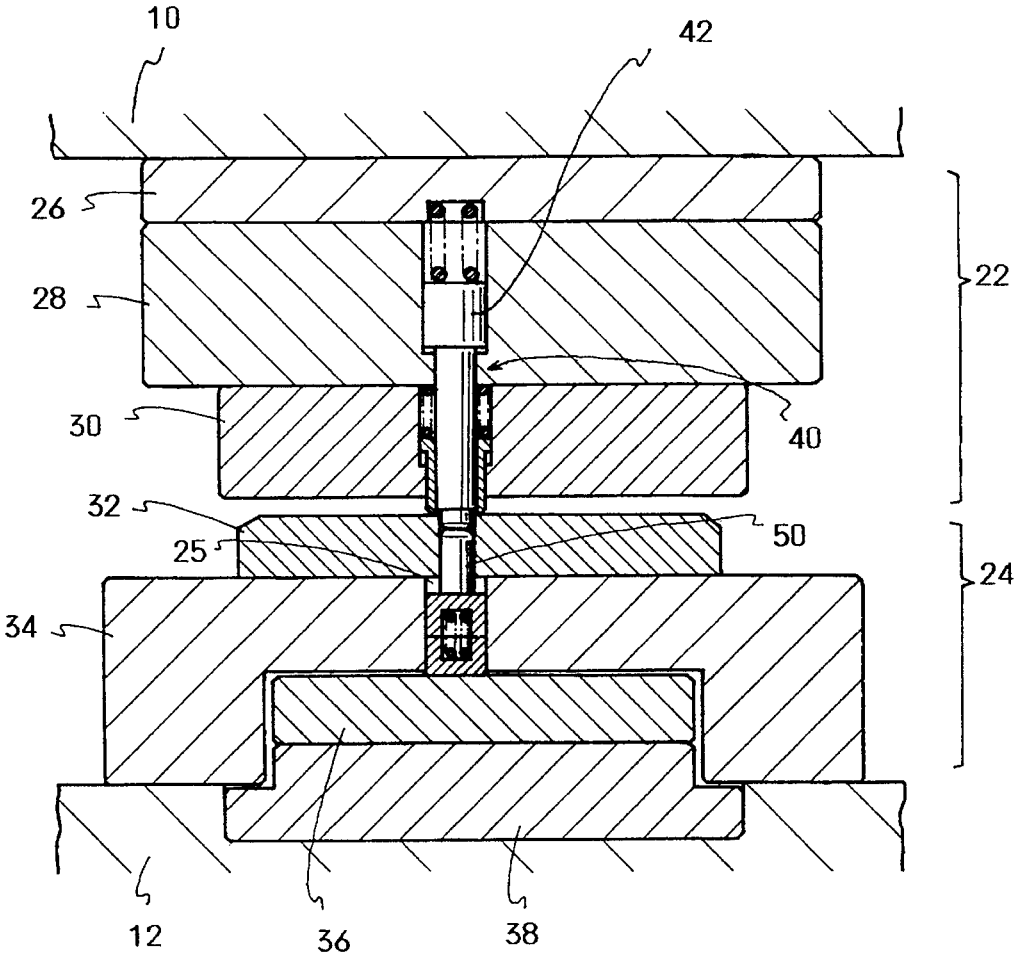
FIG. 2 is a partial sectional view of a part including a stage 20 shown in FIG. 1.

As shown in FIG. 2, the stage 20 has an upper die 22, which is fixed to the upper base 10 and a lower die 24, which is fixed to the lower base 12. The upper die 22 has a back plate 26, a punch holder 28 and a bushing holder 30; the lower die 24 has a die plate 32 and a spacer 34.

A flare-punch 40 is provided in the upper die 22. An upper end part 42 of the flare-punch 40 is capable of vertically sliding in the punch holder 28, so that the flare-punch 40 is capable of vertically moving with respect to the upper die 22. A level pin 50, which defines the lower dead point of the flare-punch 40 by contacting a lower end of the flare-punch 40, is provided in a hole 25 in the lower die 24.

The level pin 50 is provided on a jib 36 of a couple of jibs 36 and 38 whose sloping faces contact each other. Note that, the jib 36 is capable of sliding on the sloping face of the other jib 38. By sliding the jib 36 on the sloping face of the jib 38 in the direction perpendicular to the paper face of FIG. 2, the height of the level pin 50 can be adjusted.

Figure 3:
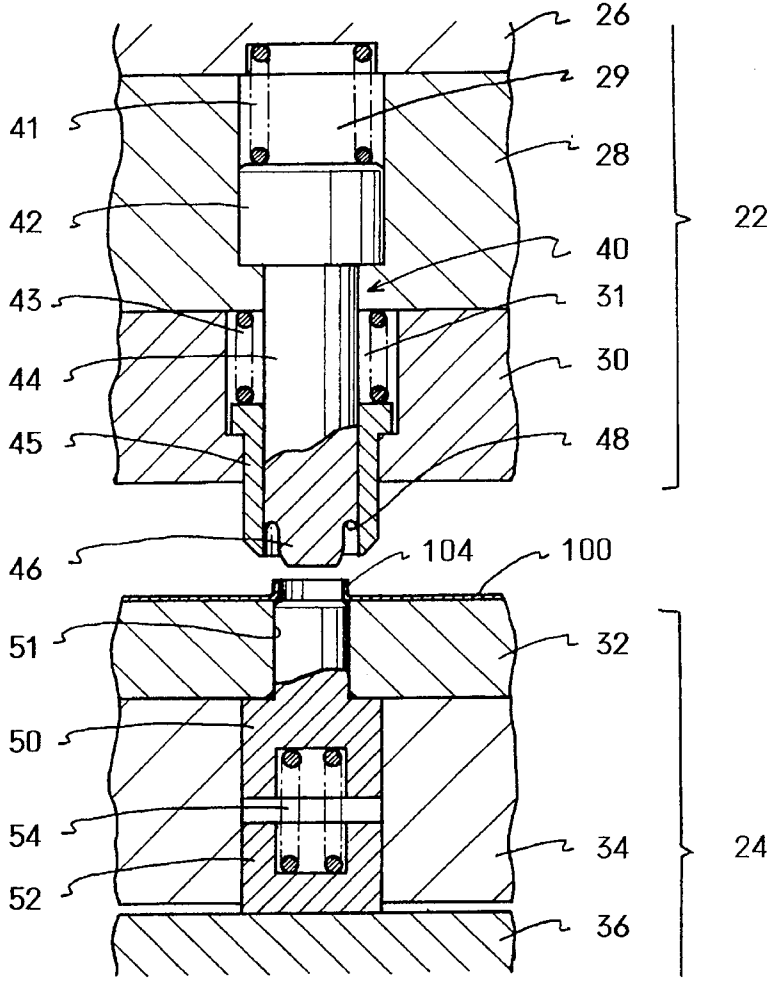
FIG. 3 is a partial sectional view of the part shown in FIG. 2 in a state that an upper die and a lower die are opened.

In FIG. 2, the upper die 22 and the lower die 24 are closed; in FIG. 3, the upper die 22 and the lower die 24 are opened.

In FIG. 3, the upper end part 42 of the flare-punch 40 is provided in a space 29, which is formed in the punch holder 28, and capable of vertically sliding on an inner face of the space 29. The flare-punch 40 is biased toward the lower die 24 by a spring 41, which is elastically provided in the space 29, and a lower end part 46 of the flare-punch 40 is projected downward from a bottom face of the upper die 22.

The elasticity of the spring 41 applies the pressing force for forming the flange section 105 at an end of the collar 104. Thus, the elasticity must be equal to or greater than the required force for forming the flange section 105. Note that, details of forming the flange section 105 will be described later.

The flare-punch 40 has a flange forming section 48 for pressing the upper end of the collar 104 to form the flange section 105. The concaved flange forming section 48 is provided in the lower end part 46 of the flare-punch 40.

A stripper-bushing 45 is slidably attached on a shaft section 44 of the flare-punch 40. The stripper-bushing 45 is biased downward by a spring 43, which is provided in a space 31, which is formed in the bushing holder 30. By the spring 43, a lower end of the stripper-bushing 45 is located in the vicinity of the lower end of the flare-punch 40.

In the lower die 24, the level pin 50 is provided on a base section 52, which is mounted on the jib 36. A spring 54 for biasing the level pin 50 toward the upper die 22 is provided between the level pin 50 and the base section 52. By the spring 54, the level pin 50 is moved upward until the upper end of the level pin 50 coincides with the upper face of an upper face of the die plate 32 when the upper die 22 and the lower die 24 are opened, so that the thin metal plate 100 can be conveyed smoothly.

The position of the upper end of the level pin 50 can be adjusted by moving the jib 38 in the direction perpendicular to the paper face of FIG. 2. Note that, the jib 38 may be moved not only by hands but also by any driving means, e.g., a motor.

Figure 4:
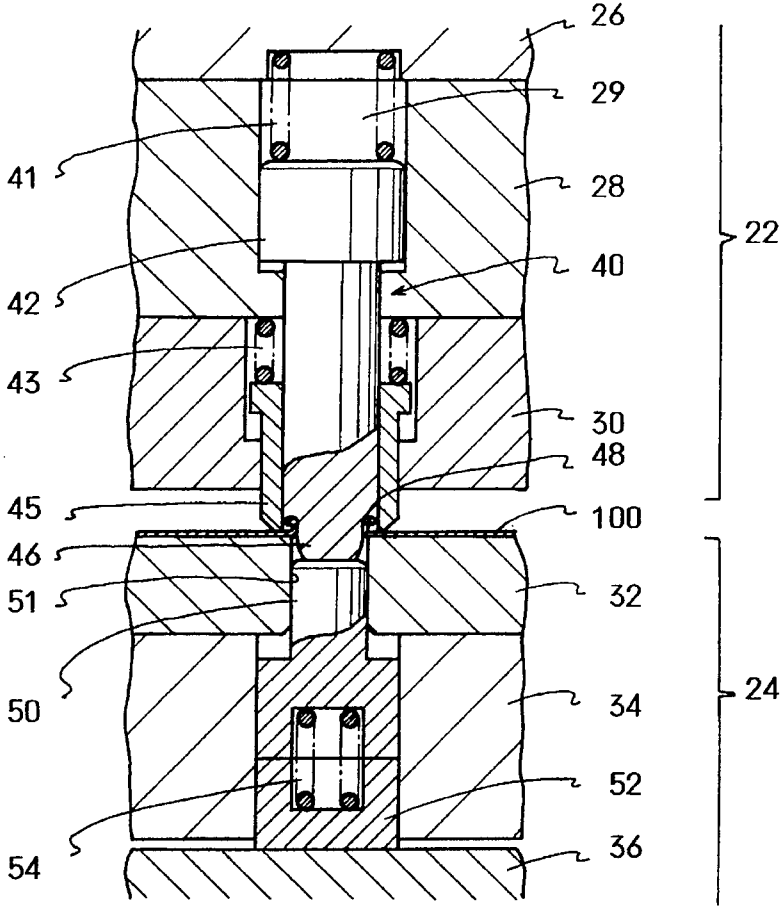
FIG. 4 is a partial sectional view of the part shown in FIG. 2 in a state that an upper die and a lower die are closed.

As shown in FIG. 3, the metal plate 100 having the collared hole is inserted between the upper die 22 and the lower die 24, which have been opened. Upon inserting the metal plate 100, the dies 22 and 24 are closed as shown in FIG. 4.

When the upper die 22 and the lower die 24 are closed, the flare-punch 40 and the stripper-bushing 45 are moved downward with the upper die 22, so the lower end of the stripper-bushing 45 contacts the metal plate 100.

Further, the flare-punch 40 is moved downward with the upper die 22, then the lower end part of the flare-punch 40 goes into the collar 104, so that the downward movement of the flare-punch 40 is guided. Finally, the lower end of the flare-punch 40 contacts the upper end of the level pin 50.

Note that, after the lower end of the stripper-bushing 45 contacts the metal plate 100, the force applied to the stripper-bushing 45 is absorbed by the spring 43 even if the upper die 22 is further moved downward, so that the stripper-bushing 45 can be maintained at the position and biases the metal plate 100 toward the lower die 24 with the elasticity of the spring 43.

The flare-punch 40, whose lower end has contacted the upper end of the level pin 50, is moved downward against the elasticity of the spring 54 in the state of contacting the level pin 50, so that the concaved flange forming section 48, which is formed in the upper end part 46 of the flare-punch 40, contacts and presses the upper end of the collar 104.

When the upper end of the collar 104 is bent by the flange forming section 48 to form the flange 105 with the prescribed collar height, the lower end of the level pin 50 contacts the base section 52, so that the flare-punch 40 reaches the lower dead point.

After the flare-punch 40 reaches the lower dead point, the upper die 22 is further moved downward, so the upper die biases the flare-punch 40 downward but the biasing force can be absorbed by the spring 41. With this structure, the flare-punch 40 can be maintained at the lower dead point, which is defined by the level pin 50.

In the die set of the present embodiment, the lower dead points of the flare-punches 40 in the stage 20 can be maintained even if the heat expansion in the press machine and the change of the number of the collared holes occurs, so that the accuracy of the collar height can be improved as much as possible.

As described above, the lower dead points of the flare-punches 40 are defined by the positions of the base sections 52, so the vertical positions of the base sections 52 must be adjusted by the jibs 38 which are capable of adjusting the height of the level pins 50 as adjusting members, so as to fix the height of the collars 104.

The force pressing the upper end of the collar 104 is defined by the elasticity of the spring 41, which biases the flare-punch 40 toward the lower die 24, so that the force is preferablly defined according to the quality of the metal plate 100.

Note that, means for biasing the flare-punch 40 downward by fluid pressure, e.g., oil pressure, air pressure, may be employed instead of the spring 41. In this case, the biasing force or the pressure can be adjusted easily.

After the flange section 105 is formed at the upper end of the collar 104, the upper member 10 is moved upward to open the dies 22 and 24 as shown in FIG. 4. During the opening, the lower end of the flare-punch 40 contacts the level pin 50 despite the flare-punch 40 moves upward with the upper die 22. But the stripper-bushing 45, which has biased toward the lower die 24 by the spring 43, presses the metal plate 100. The force pressing the metal plate 100 makes the collar 104 separate away from the lower end part 46 of the flare-punch 40. Thus, the collar 104 can be easily removed from the part 46, so that the metal plate 100 can be conveyed easily.

Since the level pin 50 is biased toward the upper die 22 by the spring 54, the level pin 50 pushes the flare-punch 40 upward and moves upward in a hole 51 until the upper end of the level pin 50 reaches the upper face of the die plate 32. By this movement, oil and scraps which have fallen into the hole 51 can be reliably removed. Further, since the level pin 50 moves until the upper end reaches the upper face of the die plate 32, the metal plate 100 can be conveyed easily.

The metal plate 100 having the collared holes with the flange sections 105 is conveyed from the stage 20 to the stage 60, and the next metal plate having the collared holes will be conveyed to the stage 20.

Figure 5:
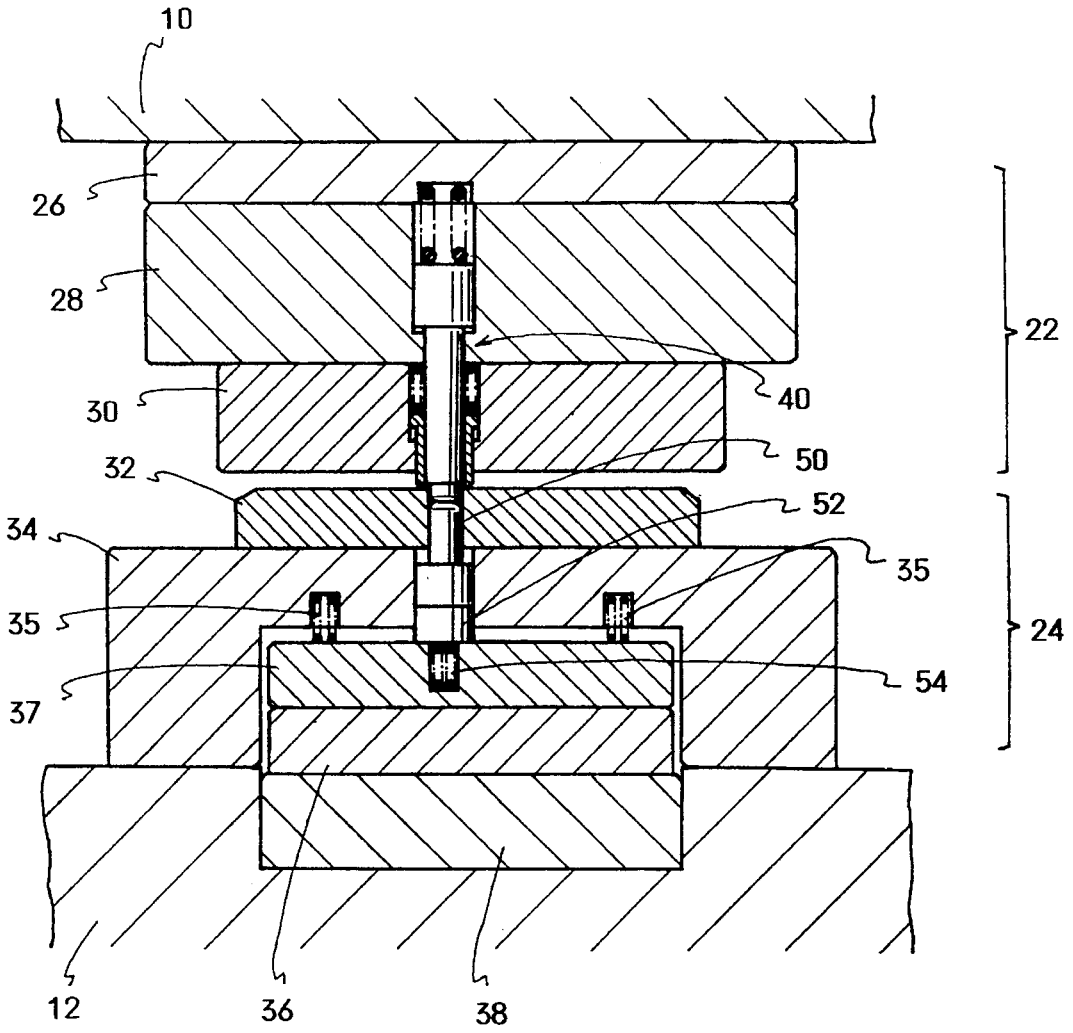
FIG. 5 is a partial sectional view of a die set of a a second embodiment.

In the die set shown in FIG. 3, the level pin 50 is provided on the base section 52, which is directly mounted on the jib 36; in the die set shown in FIG. 5, the base section 52 is provided on a plate 37, which is directly mounted on the jib 36 so as to vertically move, and the level pin 50 is provided on the base section 52. In case shown in FIG. 5, biasing members, e.g., springs 35, are elastically provided between the plate 37 and the spacer 34, so that the plate 37 is biased toward the jib 36 and the plate 37 can tightly contact the jib 36. With this structure, the plate 37 and the level pin 50 can be vertically moved by moving the jib 38 in the direction perpendicular to the paper face of FIG. 5. Note that, a biasing member, e.g., a spring 54, for biasing the level pin 50 toward the upper die 22 may be provided between the level pin 50 and the base section 52 (see FIG. 3) and may be provided between the plate 37 and the base section 52.

In FIGS. 2 and 5, the collar height is changed by changing the position of the level pin 50, which can be changed by the jibs 36 and 38, or the lower dead point of the flare-punch 40. But, as shown in FIG. 6, it can be changed by changing the vertical position of the upper face of the die plate 32 or the distance between the upper face of the die plate 32 and the concaved flange forming section 48 (see FIG. 3) of the flare-punch 40.

Figure 6:
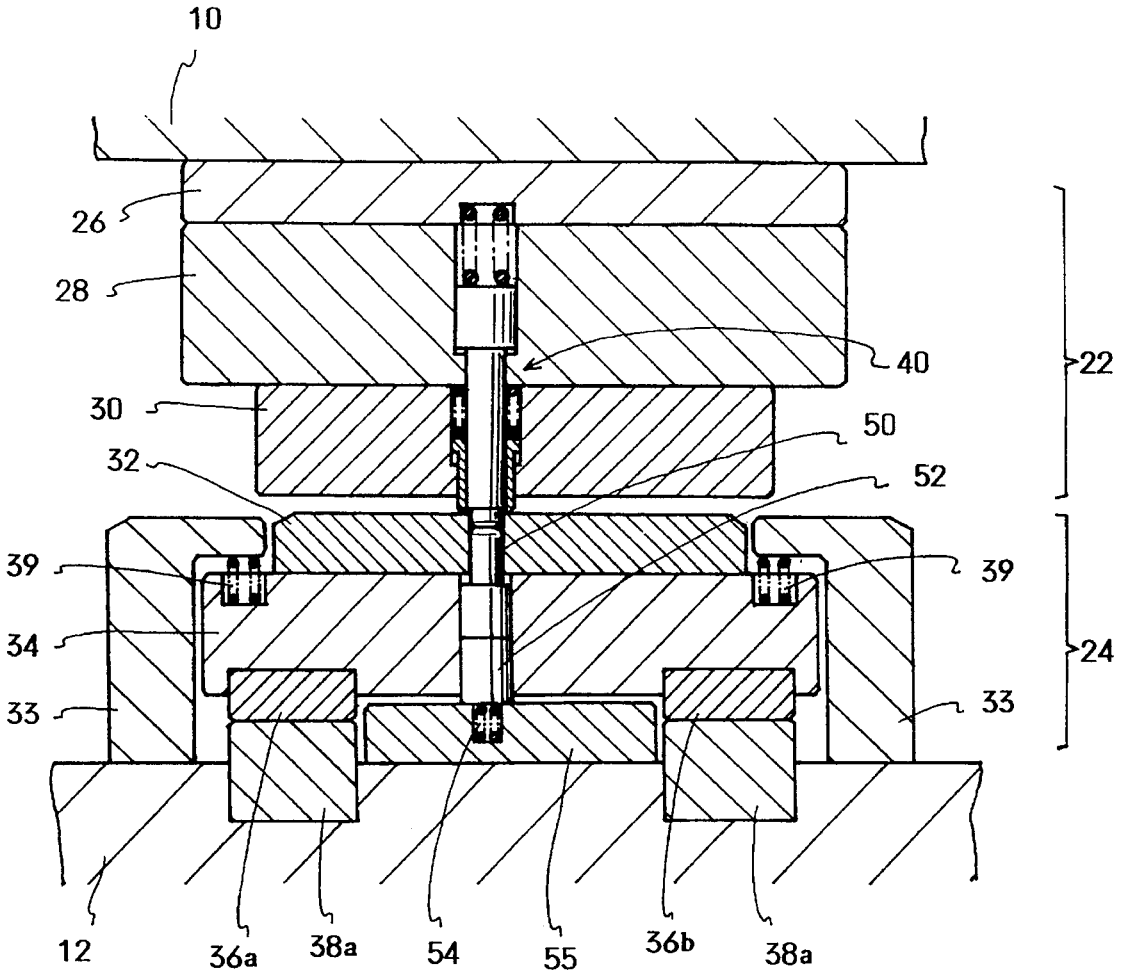
FIG. 6 is a partial sectional view of a die set of a third embodiment.

In FIG. 6, the spacer 34 on which the die plate 32 is mounted is mounted on the jibs 36*a* and 36*b*, and is biased toward the lower base 12 by the biasing members 39. With this structure, the vertical position of the die plate 32 can be adjusted by moving the jibs 38*a* and 38*b* in the direction perpendicular to the paper face of FIG. 6.

The base section 52 on which the level pin 50 is mounted is mounted on a plate 55, which is fixed on the lower base 12. When the dies 22 and 24 are closed, the position of the upper end of the level pin 50 with respect to an upper face of the lower base 12 is fixed, so that the lower dead point of the flare-punch 40 can be fixed.

Despite the lower dead point of the flare-punch 40 being fixed, the vertical position of the lower base 12 can be changed, so that the distance between the upper face of the die plate 32 and the flange forming section 48 of the flare-punch 40 can be changed. Namely, the height of the collar 104 can be changed.

In the embodiment shown in FIG. 6, the biasing member 54, e.g., a spring, for biasing the level pin 50 toward the upper die 22 may be provided between the level pin 50 and the base section 52 (see FIG. 3) and may be provided between the plate 37 and the base section 52.

In the above described embodiments, the upper die 22 is capable of vertically moving; the lower die 24 is fixed. But the lower die 24 may be capable of vertically moving; the upper die 24 may be fixed. Further, both dies 22 and 24*a* may be capable of vertically moving.

The coil springs are used as the biasing members, but leaf springs, fluid pressure means such as hydraulic units, air cylinder units, etc. may be used as the biasing members.

Further, an ejector pin, a stripper plate, etc., which are biased by a biasing member can be employed instead of the stripper-bushing 45.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. In a die set comprising:

an upper die; and a lower die being capable of relatively moving to and away from said upper die, wherein a metal plate having a through-hole, which is rounded by a collar with prescribed height, is provided between said upper die and said lower die, and a flange section is formed at an end of said collar when said upper die and said lower die are closed, wherein the improvement comprises:

a flare-punch being provided to said upper die and being capable of vertically moving therein, said flare-punch having a flange forming section for pressing the end of said collar to form said flange section, said flange forming section being provided in an end part of said flare-punch, which is capable of getting into said collar when said upper die and said lower die are closed;

a biasing member for biasing said flange forming section of said flare-punch toward said lower die with elastic force equal to or greater than a pressing force for forming said flange section; and a level pin provided in said lower die, said level pin solely defining a lower dead point of said flare-punch without reference to said upper die, said level pin being capable of coming into contact with an end of said flare-punch, which has been in said collar, when said upper die and said lower die are closed.

2. The die set according to claim 1, wherein said upper die is provided on an upper base, and said lower die is provided on a lower base, with at least one of said bases being vertically movable.

3. The die set according to claim 1, further comprising an adjusting member in said lower die for adjusting a position of said level pin.

4. The die set according to claim 1, further comprising a second biasing member in said lower die, said second biasing member being capable of moving said level pin toward said upper die when said upper die and said lower die are opened.

5. The die set according to claim 1, wherein an upper end part of said lower die is formed by a die plate, said die plate being vertically movable by at least two jibs having sloping faces which contact each other and which are slidable relative to one another.

6. The die set according to claim 1, further comprising: a stripper-bushing slidably attached to a shaft section of said flare-punch; and a fifth biasing member for biasing said stripper-bushing to make an end of said stripper-bushing contact said metal plate when said upper die and said lower die are closed, and to make the end of said stripper-bushing press the metal plate toward said lower die.

7. The die set according to claim 3, wherein said adjusting member includes at least two jibs having sloping faces which contact each other and which are slidable relative to one another to adjust the position of said level pin.

8. The die set according to claim 7, wherein said level pin is provided on one of said jibs.

9. The die set according to claim 7, further including a second biasing member for moving said level pin toward said upper die when said upper die and said lower die are opened, said second biasing member being provided between a base section located on said jib, and said level pin located on said base section.

10. The die set according to claim 7, further including a second biasing member for moving said level pin toward said upper die when said upper die and said lower die are opened, said second biasing member being provided between a plate located on said jib, and said level pin located on said plate.

11. The die set according to claim 4, wherein said second biasing member is capable of moving said level pin upward to make an end of said level pin coincide with an upper face of said lower die when said upper die and said lower die are opened.

12. The die set according to claim 9, wherein said second biasing member may move said level pin upward to make an end of said level pin coincide with an upper face of said lower die when said upper die and said lower die are opened.

13. The die set according to claim 10, further comprising a third biasing member for biasing said plate toward said jib.

14. The die set according to claim 10, wherein said second biasing member is capable of moving said level pin upward to make an end of said level pin coincide with an upper face of said lower die when said upper die and said lower die are opened.

15. The die set according to claim 5, wherein said die plate is capable of vertically moving together with a spacer provided on one of said jibs.

16. The die set according to claim 5, further comprising a second biasing member provided in said lower die, said second biasing member being capable of moving said level pin upward to make an end of said level pin coincide with an upper face of said die plate when said upper die and said lower die are opened.

17. The die set according to claim 15, further comprising a fourth biasing member for biasing said spacer toward one of said jibs.

* * * * *